US005263223A

United States Patent [19]

Fiegel et al.

[11] Patent Number: 5,263,223

[45] Date of Patent: Nov. 23, 1993

[54] APPARATUS FOR CLEANING INTERIOR SURFACES

[75] Inventors: Paul S. Fiegel; Herbert W. Meyer, both of Racine; Mark Pleshek, Milwaukee; Quenten H. Rench, Racine, all of Wis.

[73] Assignee: Von Schrader Company, Racine, Wis.

[21] Appl. No.: 844,479

[22] Filed: Mar. 2, 1992

[51] Int. Cl.[5] ..... A47L 9/00

[52] U.S. Cl. ..... 15/321; 15/323; 15/327.1; 15/264

[58] Field of Search ..... 15/321, 323, 327.1

[56] References Cited

U.S. PATENT DOCUMENTS

| | | | |
|---|---|---|---|
| 2,051,728 | 8/1936 | Manning | 15/2 |
| 2,239,183 | 4/1941 | Willard | 15/50 |
| 2,757,406 | 8/1956 | Decker | 15/231 |
| 2,844,840 | 7/1958 | Gray | 15/321 |
| 2,913,755 | 11/1959 | Buccasio | 15/323 |
| 3,262,146 | 7/1966 | Hays | 15/321 |
| 3,273,193 | 9/1966 | Soderholm et al. | 15/320 |
| 3,308,609 | 3/1967 | McCulloch et al. | 15/319 |
| 3,355,762 | 12/1967 | Cavell et al. | 15/321 |
| 3,464,081 | 9/1969 | Wisner | 15/321 |
| 3,591,889 | 7/1971 | Wisner | 15/321 |
| 3,942,217 | 3/1976 | Bates | 15/321 |
| 4,112,538 | 9/1978 | Bates | 15/321 |
| 4,216,563 | 8/1980 | Cyphert | 15/321 |
| 4,270,238 | 6/1981 | Shallenberg et al. | 15/321 |
| 4,584,736 | 4/1986 | Gremminger | 15/322 |
| 4,724,573 | 2/1988 | Østergaard | 15/321 |
| 4,809,397 | 3/1989 | Jacobs et al. | 15/321 X |
| 4,825,501 | 5/1989 | Ashby et al. | 15/321 |
| 4,845,794 | 7/1989 | Korski | 15/51 |
| 4,910,828 | 3/1990 | Blase et al. | 15/321 |
| 4,934,017 | 6/1990 | Kent | 15/321 |
| 4,959,885 | 10/1990 | Sovis et al. | 15/335 |
| 4,998,317 | 3/1991 | Passein | 15/321 |

FOREIGN PATENT DOCUMENTS

| | | | |
|---|---|---|---|
| 176697 | 4/1986 | European Pat. Off. | 15/321 |

*Primary Examiner*—Chris K. Moore

*Attorney, Agent, or Firm*—Jansson & Shupe, Ltd.

[57] ABSTRACT

The invention is an improvement in floor-standing machines for cleaning inside surfaces of buildings such as walls and ceilings. The improved machine includes a first support for supporting the apparatus in an upright orientation and a second support for supporting the apparatus in a horizontal orientation. The machine may readily be moved on the floor in the upright orientation and in dolly-like fashion and supported on the floor for use in a "face up" horizontal orientation. The machine has modular dirt-collection, cleaning solution and rinse water tanks, each of which is slidably attached to a mounting member. The tanks are readily removable for filling and/or emptying as needed. Implements such as cleaning wands and the like are conveniently stored at the side of the machine.

28 Claims, 6 Drawing Sheets

APPARATUS FOR CLEANING INTERIOR SURFACES

FIELD OF THE INVENTION

This invention is related generally to cleaning machines and, more particularly, to such machines for cleaning interior surfaces of buildings.

BACKGROUND OF THE INVENTION

Periodic cleaning of walls, ceilings and acoustical tiles is important in maintaining the appearance of building interiors. And the expanding use of acoustical tile ceilings is likely to be attended by increasing demands for cleaning services.

Nowhere is wall and ceiling cleanliness more important than in a commercial setting where customers and clients may frequently visit the building. Cleanliness of offices, hallways, public areas and the like helps make a good impression. And walls and ceilings of establishments like restaurants and lounges often become soiled more quickly than those in office buildings and, therefore, need more frequent attention.

But there are other important reasons for keeping walls, ceilings and acoustical tiles clean. Cleanliness of surroundings helps maintain employee morale and productivity and air quality.

And such cleaning costs but a fraction of the cost of re-painting ceiling and wall surfaces And unlike painting, cleaning does not "clog pores" and thereby impair the sound-absorbing characteristic of acoustical tile.

In commercial settings, such cleaning is frequently performed by professional cleaners working under contract and with cleaning machines designed for such tasks. Less often, building maintenance employees perform such work but often use machines in doing so. In any event, transportability and convenience of use are among the key factors involved in machine selection. A well-designed, technologically advanced, efficient, easy-to-use cleaning apparatus will do a better job faster. And professional cleaners will be able to move more quickly from job to job. But while such an apparatus is highly desirable, earlier workers in the field of cleaning machine design have not entirely met the needs of the application and of the machine user.

For example, U.S. Pat. No. 3,591,889 (Wisner) describes a wall and ceiling cleaning apparatus having a plurality of tanks, a pump for moving cleaning fluid to the end of a hose, and a "wet" vacuum capability. Such apparatus has a complex, two-wheeled upright frame (see FIG. 34) with locations for mounting various components. Its cleaning and rinsing solution tanks seem difficult to fill and even more difficult to empty. They are "captured" within the frame and have rigid pipes connected thereto and impairing tank removal.

U.S. Pat. No. 3,464,081 (Wisner) shows another cleaning apparatus sharing some of the disadvantages of the apparatus of the Wisner '889 patent. But it has one of its own. Its four-wheel supported, horizontal orientation suggests that it occupies a great deal of floor space in storage.

U.S. Pat. No. 2,239,183 (Willard) discloses a wall and ceiling cleaning machine with a single pump for both moving liquid to the wall and moving it away from the wall. It has no vacuum capability.

U.S. Pat. No. 4,845,794 (Korski et al.) shows a wall-cleaning machine which includes both a pump for moving liquid to the site of cleaning and suction units to remove dirty fluid.

U.S. Pat. No. 4,584,736 (Gremminger) shows a machine with both a vacuum unit and a cleaning fluid supply unit. The patent also indicates that such units may be mounted on a wheeled carriage.

An improved cleaning apparatus which has readily-removed modules, which can be moved "dolly fashion" from site to site, which has integral dry vacuum and liquid pumping capability and which stores work implements and other items would be an important advance in the art.

OBJECTS OF THE INVENTION

It is an object of this invention to provide an improved cleaning apparatus overcoming some of the problems and shortcomings of devices of the prior art.

Another object of this invention is to provide an improved cleaning apparatus particularly suited for cleaning building ceilings and interior walls.

Another object of this invention is to provide an improved cleaning apparatus which is readily moved in an upright orientation and conveniently used in a floor-supported horizontal orientation.

Still another object of this invention is to provide an improved cleaning apparatus arranged in easy-to-use modular construction.

Another object of this invention is to provide an improved cleaning apparatus having a low center of gravity for more stable apparatus moving and vehicular loading and unloading.

Yet another object of this invention is to provide an improved cleaning apparatus which stores ancillary items and equipment for immediate use.

Still another object of this invention is to provide an improved cleaning apparatus which is sturdily build for rigorous commercial use. How these and other important objects are accomplished will be apparent from the following descriptions and from the drawing.

SUMMARY OF THE INVENTION

The invention is an improvement in floor-supported or "floor-standing" apparatus for cleaning inside surfaces of buildings, particularly walls and ceilings.

In general, the improvement includes a pair of formed bars arranged in a bar-like frame and a mounting member secured to the bars and rigidifying the frame. A plurality of function modules, e.g., vacuum-tank, cleaner-tank and rinse-tank modules, are removably secured to the mounting member in side-by-side fashion. These modules are in convenient "use orientation" when the apparatus is in the horizontal orientation.

The apparatus also includes a vacuum motor and a liquid pump. The former removes dirt from surfaces to be cleaned and deposits it in the vacuum-tank module. The latter is connected to the cleaner-tank module and pumps liquid to such surfaces. As further described below, the motor and pump are mounted to provide "anti-tipping" stability and easier moving and loading or unloading to and from an elevated location such as a truck bed.

The apparatus has first and second support means formed in part by the bar-like frame. Such support means support the apparatus in upright or horizontal orientation, respectively, so that it is readily moved on and along a building floor in the upright orientation and supported on the floor for use in the horizontal orientation.

A wheeled support means, preferably including a pair of wheels each on an individual axle, is common to both the first and second support means. As viewed from the side of the apparatus, the first and second support means define intersecting first and second support planes, respectively. The wheeled support means is at the intersection of such planes so that the apparatus may be transported on the floor in rolling, dolly-like fashion substantially in the upright orientation.

The first support means, that at the bottom when the apparatus is upright, has a lower support means spaced from the wheeled support means. Such lower support means has grasping handles associated with it for use in moving the apparatus while in the horizontal orientation. With the apparatus in such orientation, the handles are "presented" upward and readily accessible.

The second support means, that at the rear of the apparatus when it is upright, has an upper support means spaced from the wheeled support means. Such upper support means has grip means, e.g., a pair of grasping handles, associated with it for use when transporting the apparatus in dolly-like fashion.

More specifically, the apparatus frame has a pair of bars which form both the upper and lower support means. Each bar includes a wheel-mounting portion for mounting a wheeled support means and the pumps are secured to the frame in positions between the first support means and the modules.

Each bar is uniquely shaped as one continuous piece, an end of each of the two bars forms the upper support means and the bars extend from such ends to form the grip means. Two spaced, parallel portions of the bars (one portion of each bar) extend from the grip means toward the first support plane and the mounting member has opposite edges affixed to such parallel portions. Such configuration helps make the frame more rigid.

Each of the bars also has a lower portion extending from the parallel portion to form the wheel-mounting portion, the lower support means, and the handles. The motor and pump, and specifically the enclosure housing them, are secured to the lower portions of the bars. Each of the lower bar portions also includes a module-support portion in contact with one of the function modules, i.e., that module directly above such portions when the apparatus is in the upright position.

The apparatus also includes a mounting member to which the modules are removably secured. The mounting member and the modules have interlocking track mounting means thereon so that the modules are firmly held by the mounting member with the apparatus in either the upright or the horizontal orientation. The interlocking track mounting means includes enlarged, rail-like tracks and a pair of complementarily shaped slots for easy, sliding mounting and removal of the modules. Preferably, the tracks protrudes from the mounting member and the slots are formed in the modules.

And the modules themselves are unique. Such modules have facing adjacent sides with complementary non-planar configurations so that the modules are "nested" together.

Convenience in use is offered in other ways in the apparatus in that it includes at least one storage member, e.g., a box-like cabinet. The storage member is secured to the mounting member in position between the upper support means and the wheeled support means. And its door is accessible in both upright and horizontal orientations.

Wall, ceiling and acoustical tile cleaning requires work members such as spray and wiping poles which are rather difficult to handle and store because of their length. The improved apparatus also has means along the side-by-side modules to accommodate storage of such elongate work members. In part, such storage is by a base member secured with respect to the lower support means and positioned to support the lower ends of the elongate work members.

The modules have aligned side surfaces with aligned recesses to receive the elongate work members when the ends of such work members are on the base member. In that way, such work members are "sheltered" in the recesses and spring clips hold the work members to prevent them from falling away. Not only are such work members thereby securely retained but they are instantly available at the start of cleaning.

DETAILED DESCRIPTIONS OF THE PREFERRED EMBODIMENTS

Figure 1:
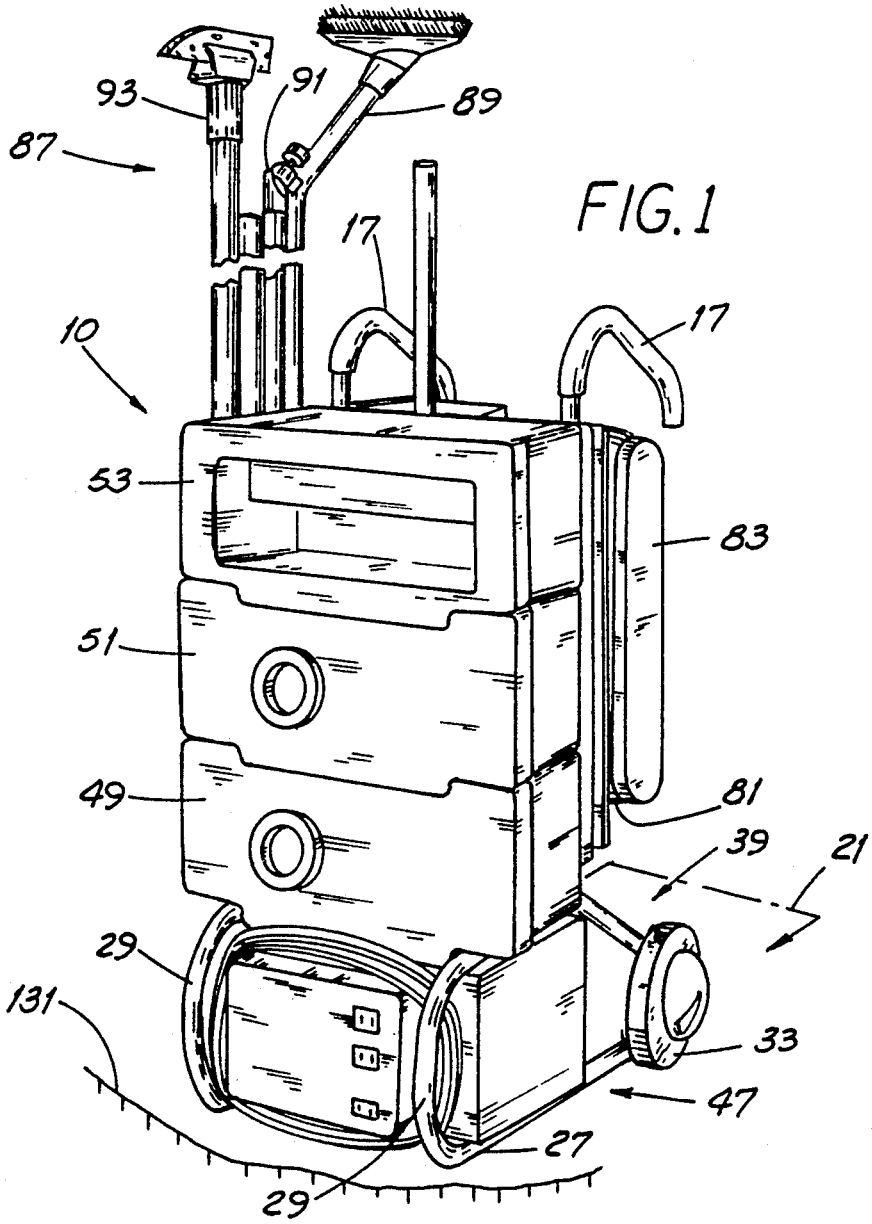
FIG. 1 is a perspective view of the front and left sides of the improved apparatus in upright orientation and with parts broken away.
Figure 5:
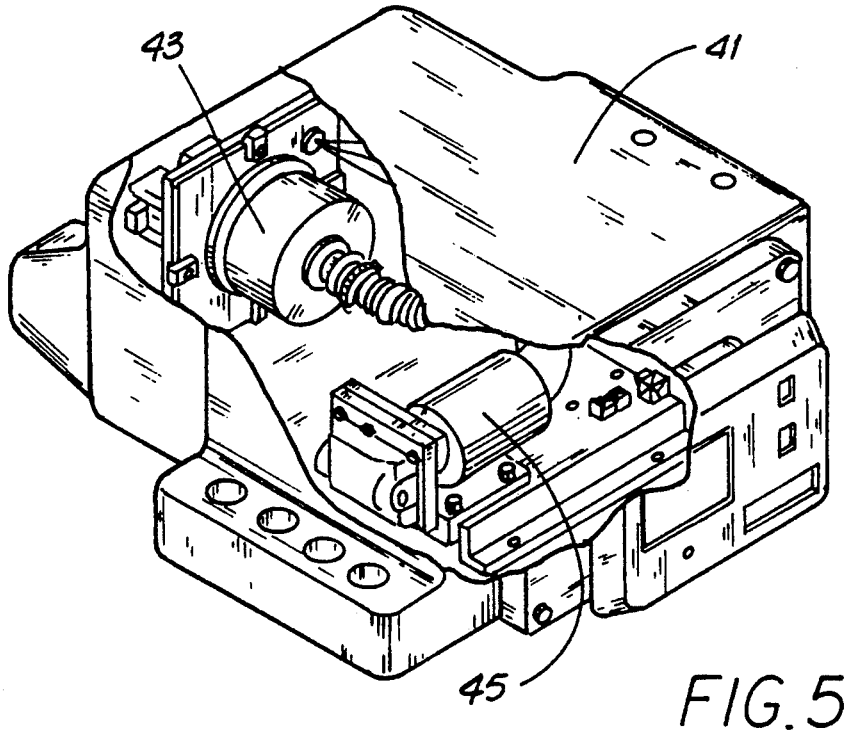
FIG. 5 is a perspective view of the electrical enclosure shown in FIG. 4 with parts broken away to show a portion of the enclosure interior.
Figure 3:
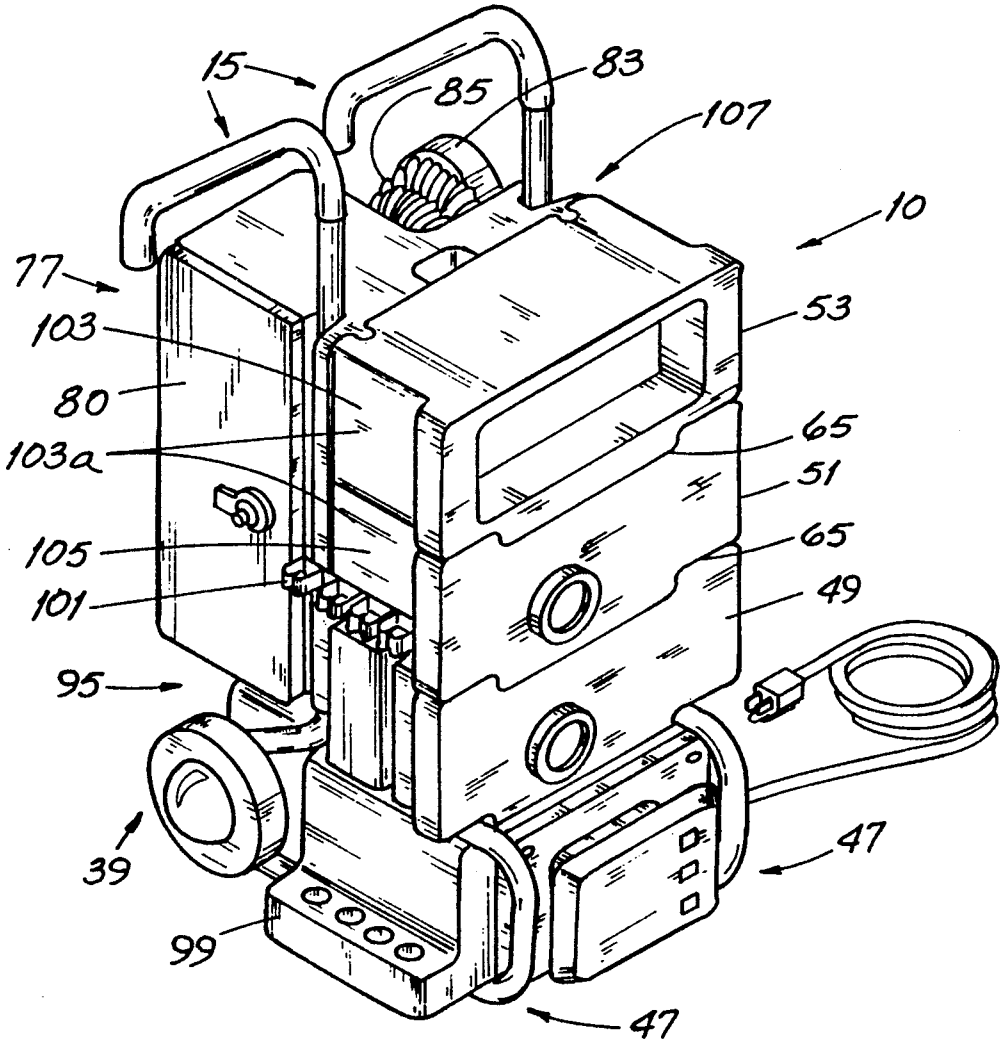
FIG. 3 is a perspective view of the front and left sides of the improved apparatus in upright orientation.

The FIGURES show the improved apparatus 10 in accordance with the invention. Unless otherwise indicated, terms such as "top," "bottom," "front," "right," "vertical," "upright" and the like are with reference to the apparatus 10 in upright orientation as shown in FIGS. 1 and 3.

Figure 4:
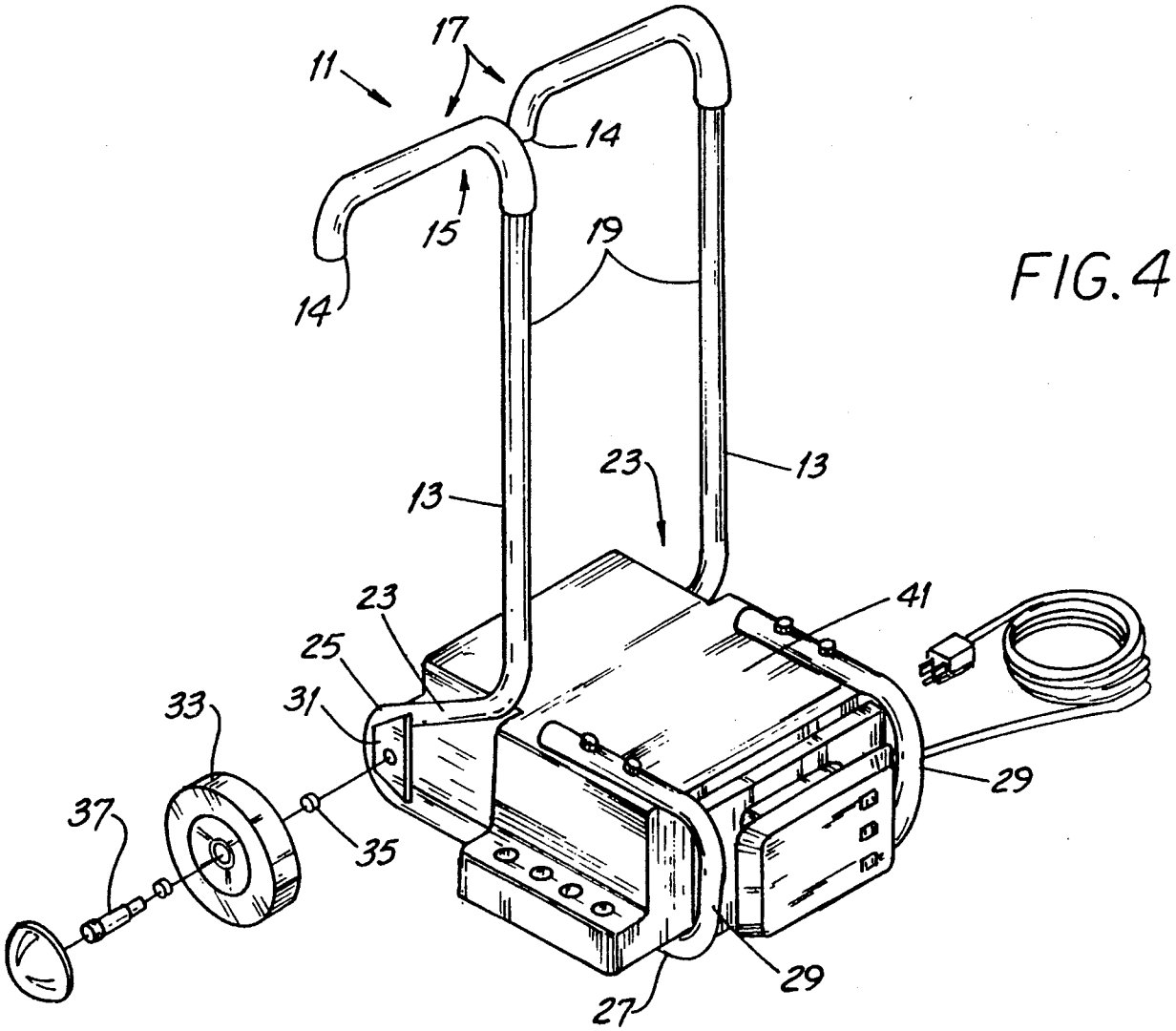
FIG. 4 is a partially-exploded, perspective view of a portion of the apparatus of FIGS. 1-3 showing the electrical enclosure mounted to the frame.

Referring to FIGS. 1 through 5, the improved apparatus 10 has a bar-like frame 11 made of two hollow, identically-formed tubes or bars 13, the shape of which is shown in FIG. 4. The upper ends 14 of the bars 13 form the upper support means 15 and each bar 13 extends from its end 14 to form the grip means 17. Each bar 13 also has a portion 19 spaced from and parallel to that of the other bar 13. Such portions 19 extend from the grip means 17 toward what is called the first support plane 21. The support means 15, plane 21 and the like are further described below.

Each bar 13 has a lower portion 23 extending from the parallel portion 19 to form the wheel-mounting portion 25, the lower support means 27 and a handle 29. Attached to each bar 13 at its wheel mounting portion 25 is a wheel support flange 31 with a wheel 33, supporting bearing 35 and axle-like shoulder bolt 37. The apparatus 10 is thereby provided with wheeled support means 39, other aspects of which are described below.

At the bottom of the apparatus 10 is an electrical enclosure 41 bolted to the bars 13 and containing a vacuum motor 43 and a liquid pump 45. The motor 43 removes dirt from surfaces to be cleaned and the pump 45 delivers cleaning liquid to such surfaces.

Figure 8:
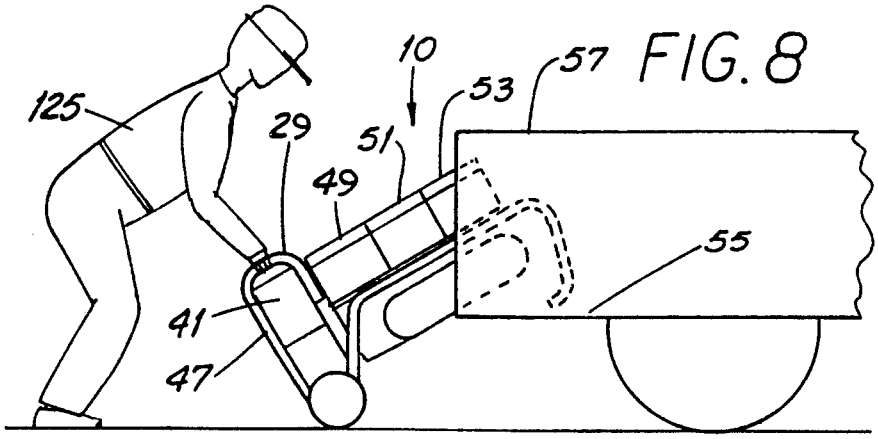
FIG. 8 is a representative side elevation view of the apparatus of FIG. 1 with parts in dashed outline and shown in conjunction with a pickup truck and an apparatus user.

Since the motor 43 and pump 45 are relatively heavy, positioning the enclosure-mounted pump 45 and motor 43 in bottom positions, i.e., to the lower portions 23 of the bars 13 and between the first support means 47 and the modules 49, 51, 53, lowers the apparatus center of gravity. Such arrangement makes it more stable when upright for storage or when nearly upright as the apparatus 10 is moved from site to site "dolly" fashion. Such arrangement is also very helpful when loading or unloading the apparatus 10 to or from an elevated surface 55, e.g., the bed of a pickup truck 57 as shown in FIG. 8.

Figure 6:
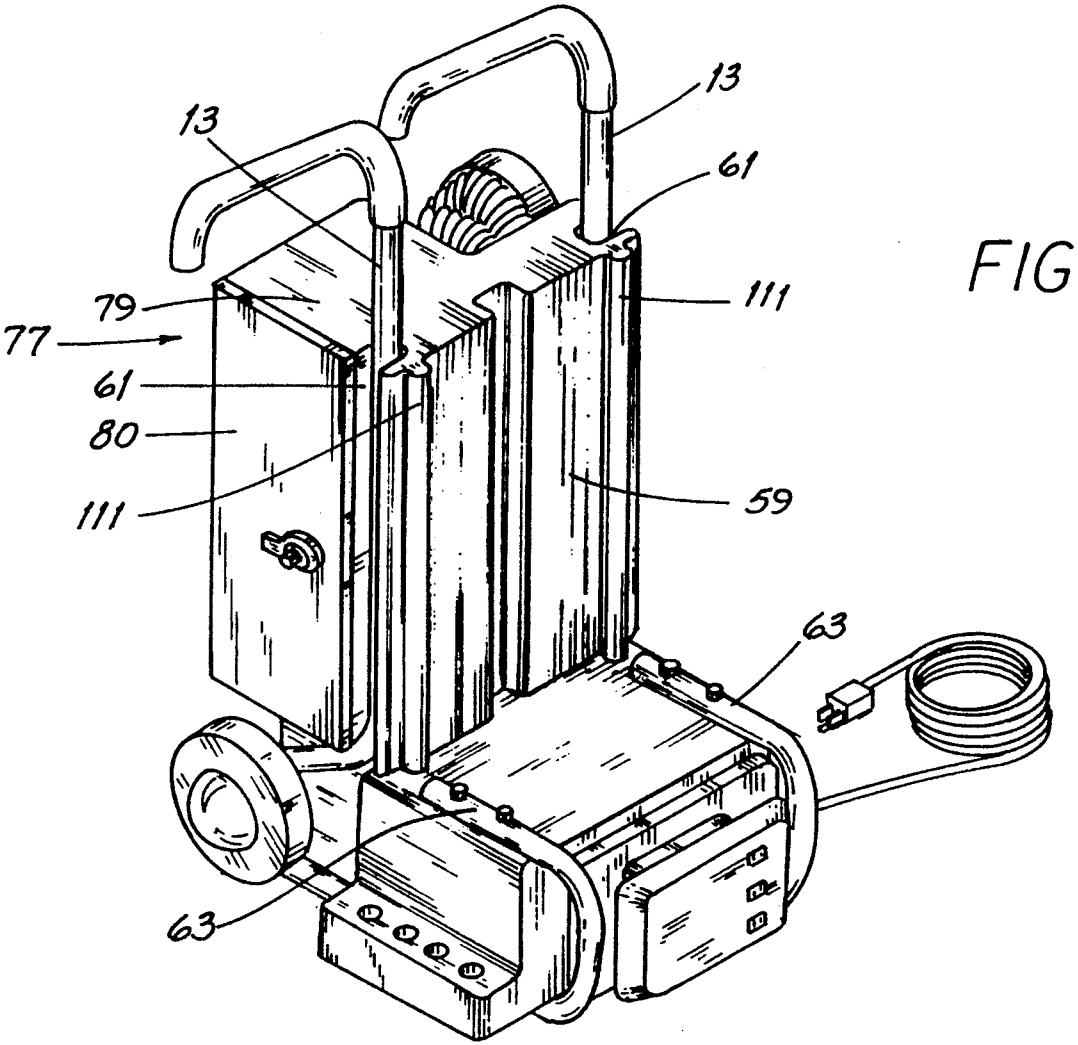
FIG. 6 is a perspective view of the apparatus shown in FIG. 3 with function modules omitted.

Referring additionally to FIG. 6, a mounting member 59 has a pair of spaced, generally parallel grooves 61, one extending vertically along either side of the member 59. The width of each groove 61 is selected to be only slightly greater than the outside diameter of a bar 13. The parallel portion 19 of a bar 13 is received in each groove 61 and secured to the member 59 by bolts or other fasteners, thus making the frame 11 substantially more rigid.

Figure 2:
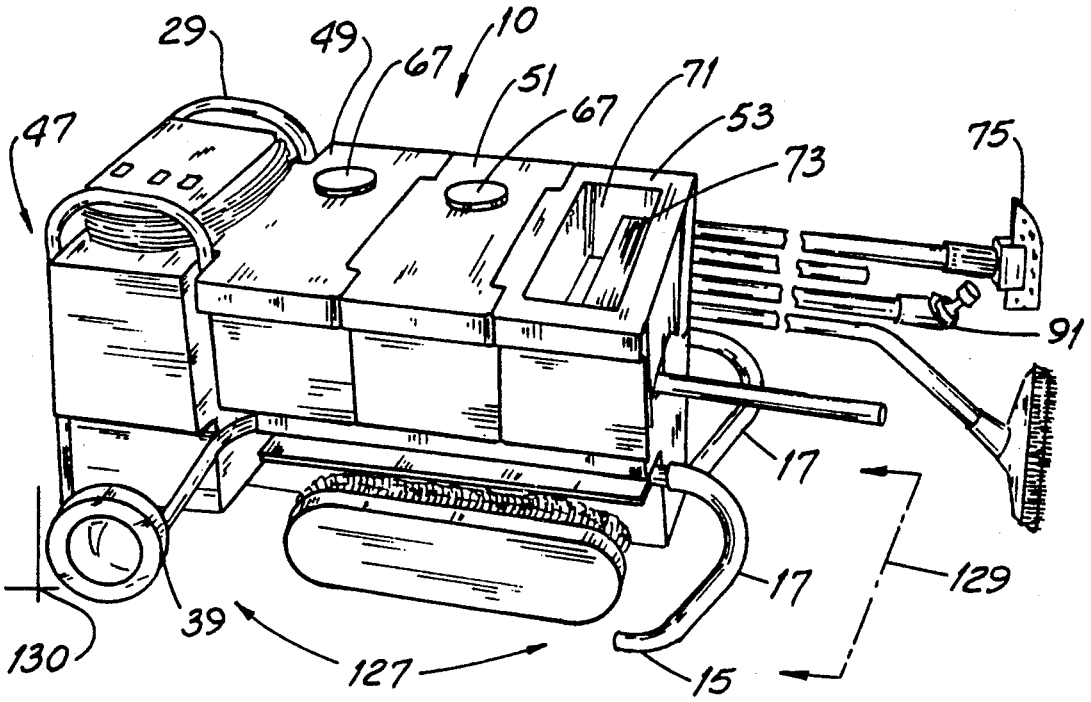
FIG. 2 is a perspective view of the front and left sides of the apparatus of FIG. 1 but in horizontal orientation and with parts broken away.

The lower portion 23 of each bar 13 has a module-support portion 63 in contact with the lower function module 49. Function modules 49, 51, 53 are arranged one atop the other (in side-by-side fashion as seen in FIG. 2) and removably secured to the member 59 in the manner described below. While such modules 49, 51, 53 can be "stacked" in any order, a highly preferred order includes a vacuum-tank module 49, a cleaner-tank module 51 and a rinse-tank module 53, in that order from bottom to top. Such arrangement is preferred in view of the fact that modules 49, 51, 53 are removed starting with the top module 53. And modules 49, 51, 53 are arranged in order of frequency of removal, the rinse-tank module 53 being removed most frequently.

Of course, modules 49, 51, 53 can have any of a wide variety of shapes. However, in the preferred embodiment, the modules 49, 51, 53 have facing adjacent sides 65 with complementary non-planar configurations so that the modules 49, 51, 53 are "nested." When so configurated, the resulting structure is reminiscent of a tongue-and-groove or dovetail joint.

The vacuum-tank module 49 has an access cap 67 and a filter (not shown) within. The module 49 is connected to the motor 43 and dust and other dry particulates are drawn into the module 49 and retained there until the module 49 is emptied as needed. Motor-to-module connection and module-to-vacuum brush connection are by hoses plugged into ports on the rear of the module 49.

The cleaner-tank module 51 has an access cap 67 and, similarly, is connected to and constitutes a reservoir for the fluid pump 45. Such pump 45 delivers cleaning solution from the module 51 to the spray pole 91 or to a wall-washing, pole-mounted glider pad (not-shown). The rinse-tank module 53 is mounted near the top of the apparatus 10 and has a water-holding cavity 71 and a grooved, slightly angled extraction "shelf 73." When performing a washing operation as described below, the sponge 75 or other cleaning implement is rinsed in water placed into the cavity 71 at the start of the cleaning operation. The implement is then pressed against the shelf 73 to remove excess water which runs back into the cavity 71. Before transporting the apparatus 10, the rinse-tank module 53 is removed from the mounting member 59 by sliding such module 53 along the track mounting means 107 forward the grip means 17. Water in the module 53 is then emptied and the module 53 returned to its position on the mounting means 107.

The apparatus 10 also includes at least one storage member 77 secured to the mounting member 59 in position between the upper support means 15 and the wheeled support means 39. Such storage member 77 includes a box-like cabinet 79 with a latching door 80 so that the user may conveniently store spare sponges, rags and the like. The storage member 77 also has a mandrel-like hose support 81 with an enlarged retainer plate 83 preventing the hose 85 from slipping off. Flexible hose 85 is stored by wrapping it around the support 81. Elongate, implement-like work members 87 used with the apparatus 10 include a vacuum brush wand 89, a spray pole 91, a sponge wiping pole 93 and the like.

The apparatus 10 also has means 95 along the modules 49, 51, 53 to accommodate storage of these tubular members 87. As shown in FIG. 3, the lower ends of such members 87 are supported on a base member 99 secured with respect to the lower support means 27 and positioned to support the work members 87. The base member 99 projects laterally from the enclosure 41 and is preferably formed as an integral part thereof. Clips 101 along the side of the apparatus 10 secure the members 87 in place for quick removal means 103 such as aligned recesses **103*a* are provided in the aligned side surfaces 105 of the modules 49, 51, 53 to receive and somewhat "shelter" the stored work members 87**.

Figure 7:
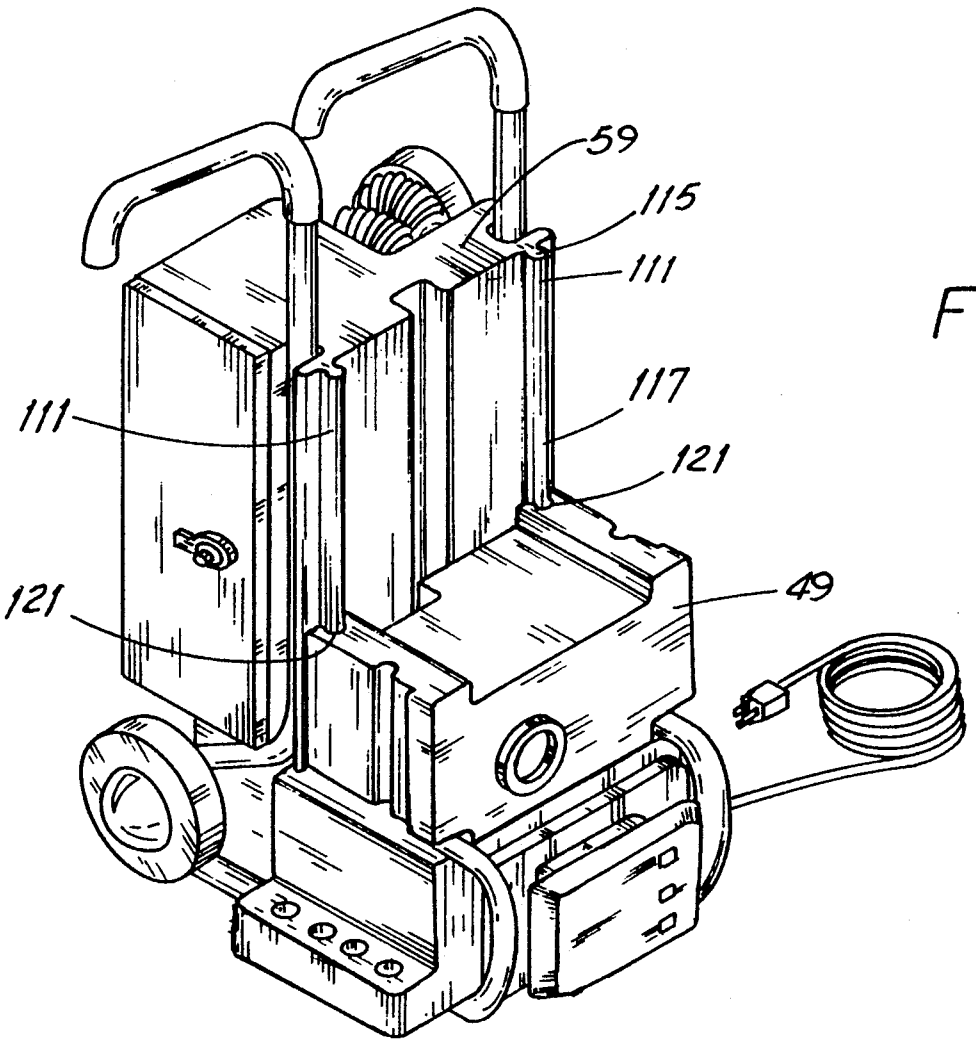
FIG. 7 is a perspective view of the apparatus shown in FIG. 3 with the vacuum-tank module mounted.

The modules 49, 51, 53 are removably secured on the apparatus 10 in a highly innovative way. Referring particularly to FIGS. 3, 6 and 7, the mounting member 59 and the modules 49, 51, 53 have interlocking track mounting means 107 thereon to firmly hold the modules 49, 51, 53 with the apparatus 10 in either the upright or the horizontal orientation. In a highly preferred embodiment, such means 107 includes a pair of parallel, spaced tracks 111 protruding forward from the mounting member 59. Each linear, generally vertical track 111 includes an elongate, relatively thin rib 115 supporting an enlarged, coextensive bead-like portion 117. In cross-section, each track 111 resembles a keyhole in shape.

Each module 49, 51, 53 includes a pair of keyhole-shaped slots 121 configured and arranged to accept the tracks 111 with sliding clearance. When mounting a module 49, 52, 53 the lower ends of the slots 121 are aligned with the upper ends of the tracks 111 and the module 49, 51, 53 slid downward into position.

Of course, there are several other ways to mount modules 49, 51, 53 without departing from the invention. As examples, the tracks 111 and slots 121 could be formed on the member 59 and modules 49, 51, 53 respectively. And such tracks 111 could be segmented or "interrupted" rather than continuous along their lengths. So-called "stab-on" attaching devices could also be used.

FIG. 1 shows the apparatus 10 in an upright orientation while in FIG. 2, the apparatus 10 is portrayed in its horizontal, "face up," ready-to-use orientation. As will become apparent, the apparatus 10 is well supported in either orientation and readily moved from work place to work place. The various apparatus support means, support planes, gripping means and handles will now be described.

The apparatus 10 has first means 47 for supporting the apparatus 10 in a upright orientation. Such support means 47 includes the lower support means 27, i.e., the "knee-like" parts of the bars 13 which are spaced forward of the wheeled support means 39. The means 47 has handles 29 associated therewith for use in moving the apparatus 10 while it is in or near the horizontal orientation of FIG. 2.

Similarly, the apparatus 10 has second means 127 for supporting the apparatus 10 in a horizontal orientation. The second support means 127 includes upper support means 15 (spaced from and above the wheeled support means 39) and also has grip means 17 associated therewith. Such grip means 17 (and, of course, the wheeled support means 39) are for use in tipping the apparatus 10 backward slightly and transporting the apparatus 10 in dolly-like fashion substantially in the upright orientation.

As best seen in FIGS. 1 and 2, the first and second support means 47, 127 define first and second support planes 21 and 129, respectively. Such planes 21, 129 intersect and include the common wheeled support means 39 at the intersection 130. Stated another way, the wheels 33 provide apparatus support in either upright or horizontal orientation.

In the upright orientation of FIG. 1, the first plane 21 and the second plane 129 are parallel and perpendicular, respectively, to a floor. In horizontal orientation (FIG. 2), such planes 21, 129 are respectively perpendicular and parallel to a floor.

In use, the apparatus 10 is brought to a work site by tilting it rearward slightly and pushing it along much as one pushes a refrigerator dolly. Once "spotted" at the work location, the apparatus 10 is reclined to the horizontal orientation, work members 87 removed for use and implement rinse water placed into the module 53. If not already substantially filled with cleaning solution, such solution is placed into the module 51. The work members 87 and the apparatus 10 are then employed to clean walls and ceilings in ways familiar to those in the cleaning field.

Following cleaning and after any necessary emptying of modules 49, 51, 53 and storage of work members 87, the user 125 grasps the grip means 17, lifts the apparatus 10 to a near-upright orientation and wheels it dolly-fashion to the next work site or to a vehicle, e.g., a pickup truck 57. FIG. 8 shows how the apparatus 10 is easily loaded. The apparatus 10 is "backed up" to the elevated surface 55 (a truck bed, for example), and the user 125 lifts the handles 29 and pushes the apparatus 10 into the truck 57. Because of its low center of gravity (due in large part to the mounting location of the enclosure 41), the apparatus 10 is much more easily managed for loading than if the apparatus 10 were "top heavy."

While the principles of this invention have been described in connection with specific embodiments, it should be understood clearly that these descriptions are made only by way of example and are not intended to limit the scope of the invention.

We claim:

1. In floor-standing apparatus for cleaning inside surfaces of buildings such as walls and ceilings, the improvement comprising:

at least one tank-like module having a cap closing the module;

first support structure for supporting the apparatus in an upright orientation, the first support structuring including at least one wheel and a first bar-like member;

second support structure for supporting the apparatus in a horizontal orientation, the second support structure including the wheel and a second bar-like member; and the cap is at the top of the module when the apparatus is supported in the horizontal orientation; and, the apparatus is taller in the upright orientation than in the horizontal orientation;

whereby the apparatus may readily be moved on the floor when tilted from the upright orientation and the apparatus is supported on the floor for use in cleaning walls and ceilings in the horizontal orientation.

2. The apparatus of claim 1 including:

a frame and a plurality of function modules removably secured to the frame;

the modules being in vertical stacked relationship when the apparatus is in the upright orientation;

said function modules being in use orientation when the apparatus is in the horizontal orientation.

3. The apparatus of claim 1 wherein the modules include a vacuum-tank module and a cleaner-tank module.

4. The apparatus of claim 3 including at least one cleaning implement and wherein the modules further include a rinse-tank module for holding implement rinse water.

5. The apparatus of claim 2 including monitoring member to which the modules are removable secured, the mounting member and the modules having an interlocking track structure thereon for mounting the modules on the mounting member, whereby the modules are firmly held by the mounting member with the apparatus in either the upright orientation or the horizontal orientation.

6. The apparatus of claim 5 wherein the modules have facing adjacent sides with complementary non-planar configurations, whereby the modules are nested.

7. The apparatus of claim 1 wherein the first and second support structures define intersecting first and second support planes, respectively, and include a common wheeled support at the intersection of such planes, whereby the apparatus may be transported on the floor in dolly-like fashion substantially in the upright orientation.

8. The apparatus of claim 7 wherein the second support structure also includes an upper support spaced from the wheeled support, the upper support having grips associated therewith for use in transport of the apparatus in the dolly-like fashion substantially in the upright orientation.

9. The apparatus of claim 8 wherein the first support structure also includes a lower support spaced from the wheeled support, the lower support having handles associated therewith for use in moving the apparatus to an elevated location.

10. The apparatus of claim 9 comprising a frame having a pair of bars forming both the upper and lower supports, the bars including wheel-mounting portions for mounting the wheeled support.

11. The apparatus of claim 10 further comprising:

a mounting member secured to the bars thereby rigidifying the frame; and a plurality of function modules removably secured to the mounting member in side-by-side fashion.

12. The apparatus of claim 1 wherein the mounting member and the modules have an interlocking track mounting structure thereon for mounting the modules on the mounting member, whereby the modules are firmly held by the mounting member with the apparatus in either the upright orientation or the horizontal orientation.

13. The apparatus of claim 12 further comprising at least one storage member secured to the mounting member in position between the upper support and the wheeled support.

14. The apparatus of claim 12 further comprising means along the side-by-side modules to accommodate storage of elongate work members.

15. The apparatus of claim 14 further comprising:

a base member secured with respect to the lower support, the base member positioned to support ends of the elongate work members; and the modules having aligned side surfaces with aligned recesses to receive the elongate work members when the ends of such work members are on the base member.

16. The apparatus of claim 1 wherein each of the bars includes:

an end forming the upper support, the bar extending from the end to form a grip;

a portion extending from a grip toward the first support plane and parallel to the corresponding portion of the other bar, the mounting member having opposite edges affixed to the parallel portions; and a lower portion extending from the parallel portion to form the wheel-mounting portion, the lower support, and the handles.

17. The apparatus of claim 16 wherein the mounting member and the modules have an interlocking track mounting structure thereon for mounting the modules on the mounting member, whereby the modules are firmly held by the mounting member with the apparatus in either the upright orientation or the horizontal orientation.

18. The apparatus of claim 17 wherein the modules have facing adjacent sides with complementary nonplanar configurations, whereby the modules are nested.

19. The apparatus of claim 16 wherein the lower portions of the bars also includes module-support portions in contact with one of the function modules.

20. In apparatus for cleaning inside surfaces of buildings such as walls and ceilings, the improvement comprising:

a frame supporting the apparatus when the apparatus is upright or horizontal;

a plurality of function modules removably secured to the frame, each module having a separate function when operating the apparatus;

the modules are side-by-side when the apparatus is horizontal; and the modules are vertically stacked when the apparatus is upright; and, the modules are retained on the frame, irrespective of whether the apparatus is upright or horizontal.

21. The apparatus of claim 20 wherein the modules include a vacuum-tank module and a cleaner-tank module.

22. The apparatus of claim 21 wherein the modules further include a rinse-tank module.

23. The apparatus of claim 20 including a mounting member to which the modules are removable secured, the mounting member and the modules having an interlocking track mounting structure thereon for mounting the modules on the mounting member, whereby the modules are firmly held by the mounting member.

24. The apparatus of claim 23 further comprising at least one storage member secured to the mounting member in position.

25. The apparatus of claim 23 further comprising means along the side-by-side modules to accommodate storage of elongate work members.

26. The apparatus of claim 23 wherein the modules have facing adjacent sides with complementary nonplanar configurations, whereby the modules are nested.

27. The apparatus of claim 23 wherein the frame is a pair of bars and the mounting member is secured to the bars thereby rigidifying the frame.

28. The apparatus of claim 27 wherein the modules have facing adjacent sides with complementary nonplanar configurations, whereby the modules are nested.

* * * * *

UNITED STATES PATENT AND TRADEMARK OFFICE

CERTIFICATE OF CORRECTION

PATENT NO. : 5,263,223

DATED : November 23, 1993

INVENTOR(S) : Paul S. Fiegel et al.

It is certified that error appears in the above-indentified patent and that said Letters Patent is hereby corrected as shown below:

Under "Inventors" on the title page, delete "Quenten" and insert --Quentin--.

In column 1, line 29, insert --.-- after "surfaces".

In column 8, line 29, delete "monitoring" and insert --mounting--.

In column 8, line 30, delete "removable" and insert --removably--.

In column 10, line 24, delete "removable" and insert --removably--.

Signed and Sealed this

Fourteenth Day of June, 1994

Bruce Lehman

*Attest:*

BRUCE LEHMAN

*Attesting Officer*

*Commissioner of Patents and Trademarks*